US005782513A

United States Patent [19]

Nazzari

[11] Patent Number: 5,782,513

[45] Date of Patent: Jul. 21, 1998

[54] SECURITY SEAL

[75] Inventor: Ian Nazzari, Moraga, Calif.

[73] Assignee: NIC Products, Inc., Walnut Creek, Calif.

[21] Appl. No.: 686,584

[22] Filed: Jul. 26, 1996

[51] Int. Cl.[6] ..... B65D 27/30

[52] U.S. Cl. ..... 292/319; 292/317

[58] Field of Search ..... 292/317, 318, 292/319, 320, 321, 328

[56] References Cited

U.S. PATENT DOCUMENTS

| | | | |
|---|---|---|---|
| 1,059,689 | 4/1913 | Webb | 292/319 |
| 1,987,737 | 1/1935 | Goddard | 292/317 |
| 2,809,065 | 10/1957 | Erke | 292/321 |
| 3,591,223 | 7/1971 | Neto | 292/320 |
| 3,736,017 | 5/1973 | Kaiho | 292/317 |
| 3,954,294 | 5/1976 | Iwamoto et al. | 292/318 |
| 4,106,801 | 8/1978 | Neto | 292/307 R |
| 4,175,782 | 11/1979 | Neto | 292/307 R |
| 4,722,562 | 2/1988 | Burt | 292/318 |
| 4,818,002 | 4/1989 | Neto | 292/307 R |
| 4,940,268 | 7/1990 | Lesquir et al. | 292/317 |
| 4,968,075 | 11/1990 | Lesquir et al. | 292/321 |
| 5,118,148 | 6/1992 | Netto | 292/320 |
| 5,180,200 | 1/1993 | Georgopoulos | 292/326 |
| 5,348,180 | 9/1994 | Shepard | 220/214 |
| 5,402,958 | 4/1995 | Mahaney | 242/388.1 |
| 5,489,034 | 2/1996 | Netto | 215/212 |

FOREIGN PATENT DOCUMENTS

| | | | |
|---|---|---|---|
| 2262421 | 7/1973 | Germany | 292/320 |
| 660127 | 1/1964 | Italy | 292/317 |
| 2168654 | 6/1986 | United Kingdom | 292/320 |

*Primary Examiner*—Rodney M. Lindsey
*Attorney, Agent, or Firm*—Rivkin, Radler & Kremer; Deanna J. Shirley

[57] ABSTRACT

A security seal of superior ergonomic design, having a capsule and anchor shaped to conform to the fingers and thumb. The seal also has an integral wire which conforms to the anchor to be securely and irreversibly held within the capsule.

1 Claim, 3 Drawing Sheets

SECURITY SEAL

I. FIELD OF THE INVENTION

The invention relates to a wire security seal of superior ergonomic design which is often used to secure closure of meter or postal boxes. Because the seal cannot be opened without being broken, and the wire cannot be removed, it also provides evidence of tampering. The superior ergonomic design makes the seal easier to put into place.

II. BACKGROUND OF THE INVENTION

The wire security seals that are well known, previously disclosed in patents and are in the public domain are comprised of similar housings with a stud shaped for non-removable engagement with the capsule. These wire seals have several shortcomings. Firstly, they are difficult to close with one hand or with gloved hands. Secondly, the wire may be pulled out and pushed back in without leaving evidence of tampering.

This improved seal bears the following ergonomic improvements: it can be closed with one hand; it is internally "self-threading" and thus can be closed by a gloved hand; the wire cannot be pulled out; if the wire is cut, it cannot be pushed back in.

| | | | |
|---|---|---|---|
| 3,591,223 | 1971 | Castro Neto | 292#320 |
| 4,106,801 | 1978 | Castro Neto | 292#307R |
| 4,175,782 | 1979 | Castro Neto | 292#307R |
| 4,818,002 | 1989 | Castro Neto | 292#307R |
| 4,722,562 | 1988 | Burt | 292#318 |
| 5,180,200 | 1993 | Georgopoulos | 292#326 |
| 5,348,180 | 1994 | Shepard | 220#214 |
| 5,402,958 | 1995 | Mahaney | 242#388.1 |
| 5,489,034 | 1996 | Netto | 215#212 |

III. SUMMARY OF THE INVENTION

The invention provides a user-friendly security wire seal of superior ergonomic design of the type having a capsule and sealing member or anchor. The capsule and anchor are connected by an arm and the unit in its entirety is best manufactured of injection-molded plastic. The capsule has apertures through which the wire is threaded. The threaded wire, as it is pushed by the anchor, bends at numerous points, making it impossible to pull out, and the wire is pressed upon closure into the channel of the anchor (or, in another embodiment in the channel of the capsule), also making it impossible to pull out. The capsule is shaped for easier gripping. In one embodiment, the capsule is easily gripped as it is shaped to rest atop the index finger while pressure is applied to the top of the anchor with the thumb to easily close the capsule. This seal is much easier to close with one hand than seals currently in use. Further, the top surface of the anchor and the bottom surface of the capsule are larger in dimension than the capsule, for easier gripping.

In another embodiment, the top surface of the sealing member bears a trade logo.

IV. BRIEF DESCRIPTION OF THE DRAWINGS

V. DESCRIPTION OF THE PREFERRED EMBODIMENT

Figure 1:
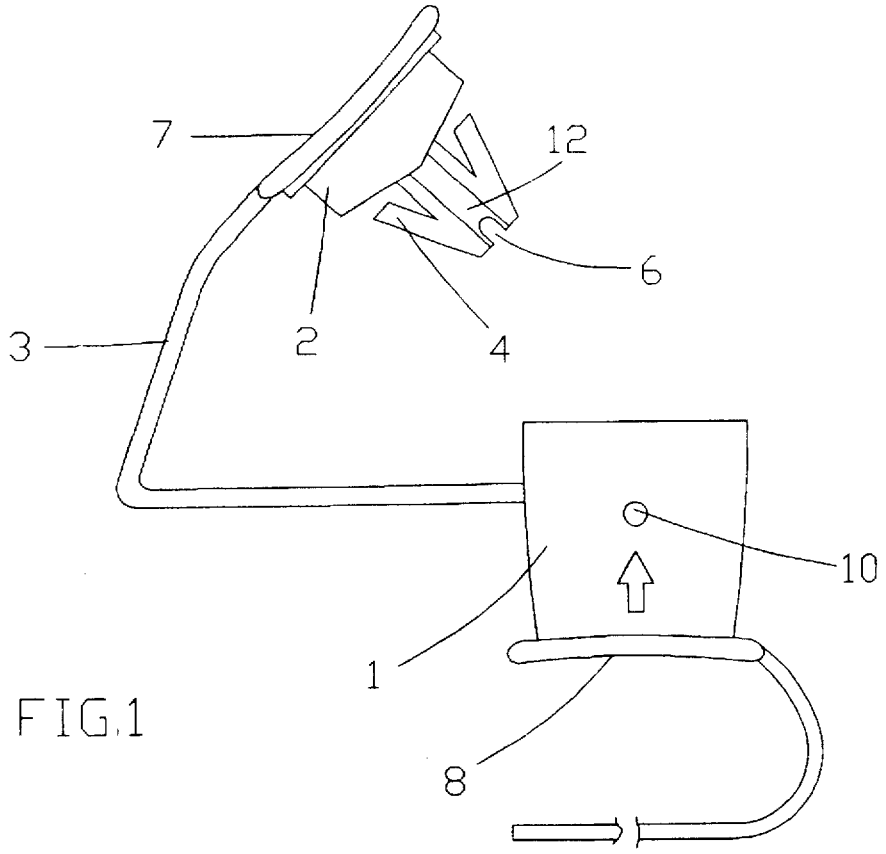
FIG. 1 is a front elevation of a seal.
Figure 2:
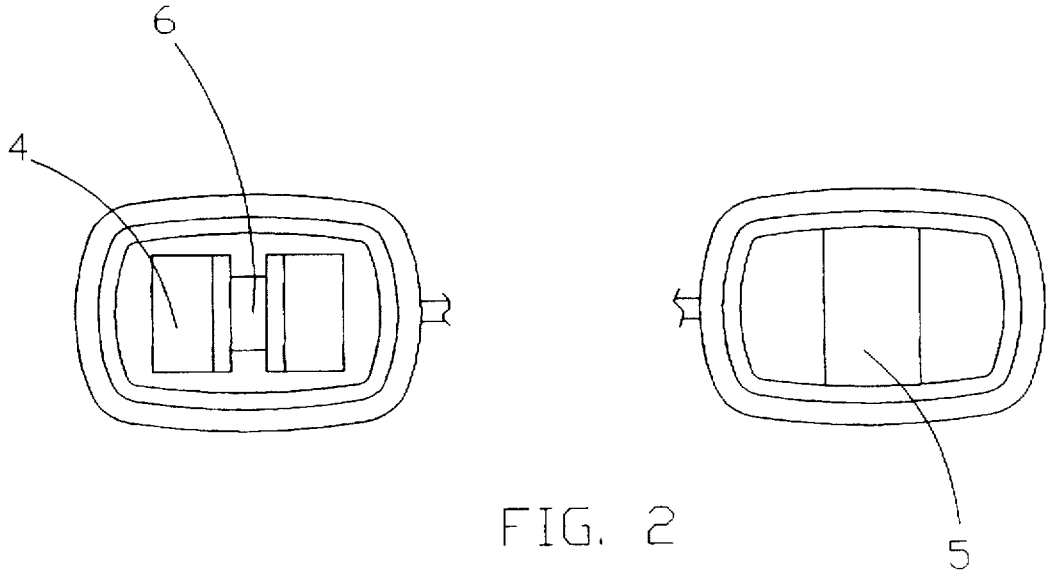
FIG. 2 is a plan view of the seal in an open position.
Figure 3:
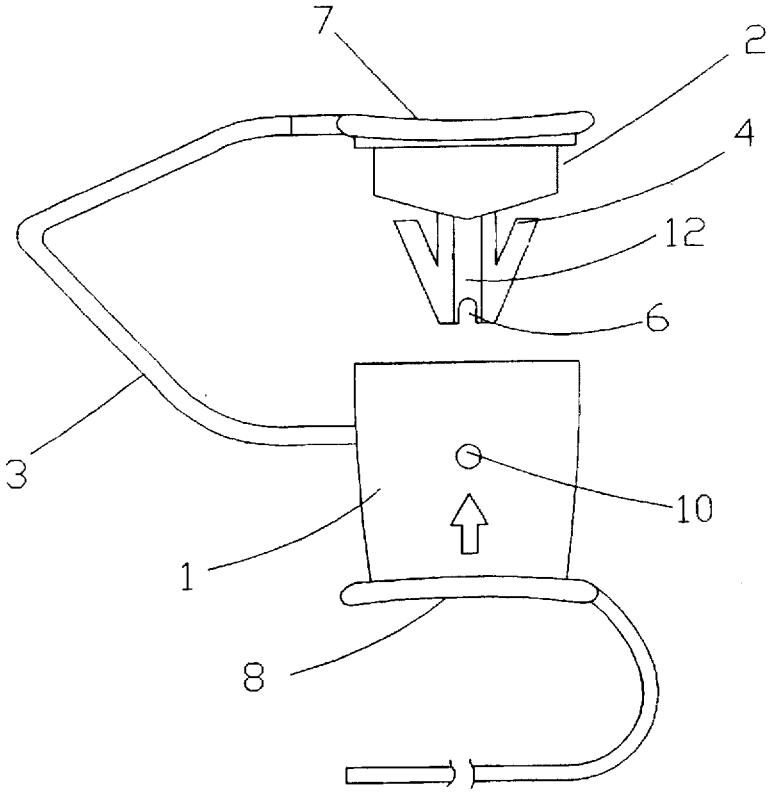
FIG. 3 is a front elevation of a capsule, showing the anchor approaching the closing position and the embodiment in which a wire is integral with the base of a capsule.
Figure 4:
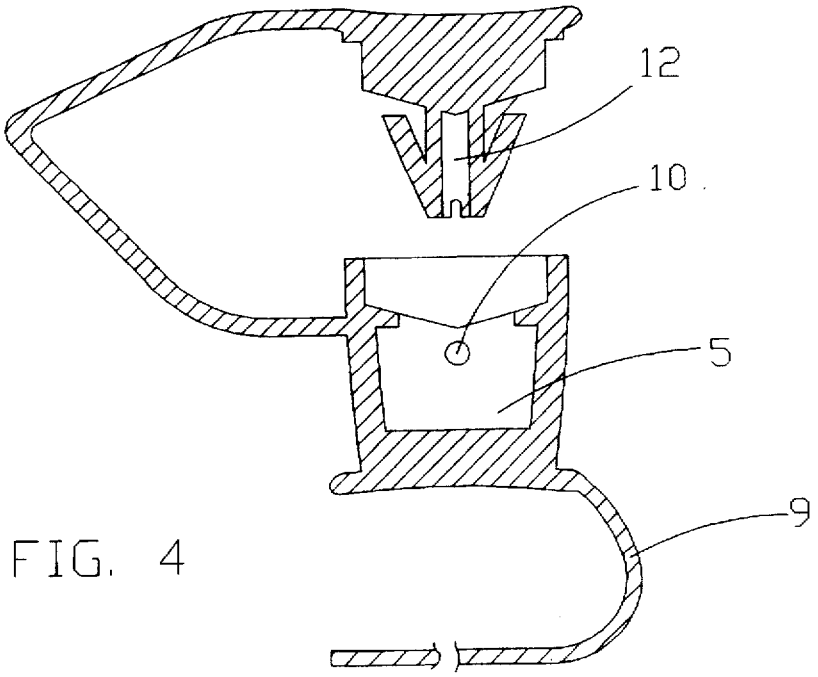
FIG. 4 is a cut away front elevation revealing the interior of the capsule.
Figure 5:
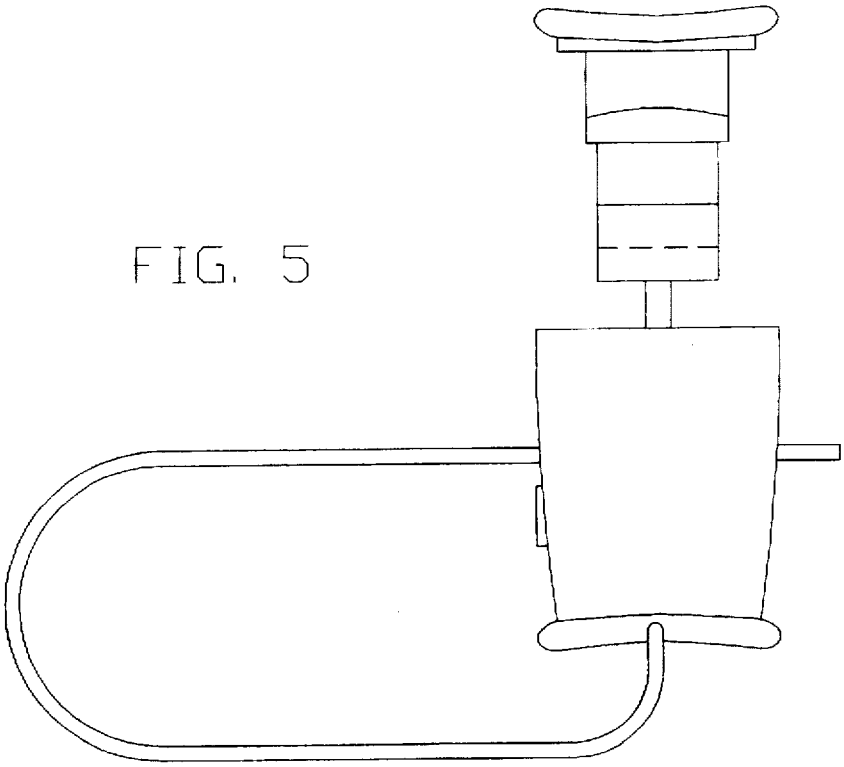
FIG. 5 is a side elevation in which the anchor is approaching the closed position.
Figure 6:
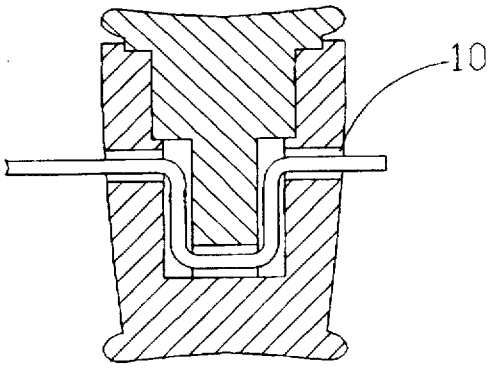
FIG. 6 is the cut away side elevation of the capsule in the closed position revealing the interior of the capsule and the wire.

The capsule (1) and anchor (2), linked by a connecting arm (3), are manufactured of resilient injection-molded plastic. The connecting arm protrudes away from the capsule and returns to the capsule at an acute angle, thereby increasing the ease with which the anchor is inserted into the capsule and minimizing any resistance to closure by the connecting arm. The anchor comprises a male fitting (4) which, when in the closed position, mates with a female fitting (5), which is in the interior of the capsule. The anchor also comprises a groove (6).

The top surface (7) of the anchor and the bottom surface (8) of the capsule are larger in dimension than the capsule and are shaped to conform to fingers and thumb, all for easier gripping and closure.

The wire (9) is integral with the seal and threaded through the apertures (10) (and 11 not shown) of the capsule. The wire is engaged by the groove of the anchor as the device is closed, and is forced into the interior of the capsule. A channel (12) along the exterior of the anchor (or on the interior of the capsule, not shown in drawings) increases the internal security of the wire. Also increasing security, the wire is crimped in numerous places as it conforms to the interior of the capsule, the groove, and the channel.

In its closed position, the male fitting is irreversibly engaged with the female fitting, the wire is held securely in place by the groove and the channel and is crimped at many places and cannot be pulled out.

I claim:

1. A wire security seal comprising a closure system of ergonomic design, said seal comprising a capsule, said capsule comprising interior and exterior surfaces; an open end and a closed end, at least two apertures, a female fitting formed by the interior surface of the capsule;

a bottom surface at the closed end, the bottom surface comprising a first contour corresponding to the shape of a user's index finger;

an anchor sized to be received within the capsule, said anchor comprising a male fitting which is complementary to and suitable to be irreversibly engaged by the female fitting, said anchor comprising a groove, a top surface said top surface comprising an area which is somewhat larger than an area of the open end of the capsule, the top surface comprising a second contour to accommodate a user's thumb a connecting arm integrally formed of the capsule and the anchor, said connecting arm linking the capsule and the anchor, said connecting arm projecting away from the capsule at a right angle for some portion and then back toward the capsule at an acute angle;

a wire of suitable size integral with the seal to be received through the apertures and within the groove;

the apertures for receiving the wire and for aligning the wire with the groove in the anchor as the anchor is pushed into the open end of the capsule, the anchor for engaging the wire as the wire is received in the apertures via the anchor's groove such that the wire, as the anchor and capsule are engaged, is received into the groove is pushed progressively into the capsule, and is bent at numerous points according to the shape of the interior of the capsule, the anchor is irreversibly engaged to the female fitting and the wire is held in place by the anchor and cannot be pulled out without destroying the capsule or otherwise leaving evidence of tampering.

* * * * *

UNITED STATES PATENT AND TRADEMARK OFFICE

CERTIFICATE OF CORRECTION

PATENT NO. : 5,782,513
DATED : July 21, 1998
INVENTOR(S) : Ian Nazzari

It is certified that error appears in the above-identified patent and that said Letters Patent is hereby corrected as shown below:

Column 3,
Line 4, change "groove" to -- groove, --

Signed and Sealed this

Thirtieth Day of April, 2002

*Attest:*

*Attesting Officer*

JAMES E. ROGAN
*Director of the United States Patent and Trademark Office*